US005463826A

United States Patent [19]

Horiuchi

[11] Patent Number: 5,463,826

[45] Date of Patent: Nov. 7, 1995

[54] SWIMMING TOY FISH AQUARIUM HAVING MULTIPLE TOY FISH AND DIFFERENT MAGNET POSITIONS

[75] Inventor: Shigeyuki Horiuchi, Koshigaya, Japan

[73] Assignee: Masudaya Corporation, Tokyo, Japan

[21] Appl. No.: 226,022

[22] Filed: Apr. 11, 1994

Related U.S. Application Data

[63] Continuation-in-part of Ser. No. 41,566, Apr. 2, 1993, Pat. No. 5,301,444.

[51] Int. Cl.[6] ..... G09F 19/00

[52] U.S. Cl. ..... 40/426; 446/134

[58] Field of Search ..... 446/131, 133–136; 40/426, 406; 273/456; 472/67

[56] References Cited

U.S. PATENT DOCUMENTS 3,239,956 3/1966 Canonica, Jr. ..... 40/426
3,425,157 2/1969 Hartsock ..... 446/134
5,050,876 9/1991 Chuang ..... 446/134 X

FOREIGN PATENT DOCUMENTS 12285 of 1911 United Kingdom ..... 446/134

OTHER PUBLICATIONS

German Patentanmeldung P 12239 X1/77f, Pabler, Nov. 1955.

*Primary Examiner*—Mickey Yu

[57] ABSTRACT

A marine display device include a liquid vessel containing one or more toy fish, each fish containing an air chamber to impart buoyancy to the fish and a magnetic member. A pair of spaced apart chambers project upwardly from the base of the vessel, and a rotatable magnetic field-producing member is disposed in each of said chambers, and is operatively connected to a rotatable shaft which is rotatably driven by a motor.

21 Claims, 10 Drawing Sheets

SWIMMING TOY FISH AQUARIUM HAVING MULTIPLE TOY FISH AND DIFFERENT MAGNET POSITIONS

RELATED APPLICATION

This application is a continuation-in-part of application Ser. No. 08/041,566 filed Apr. 2, 1993 now U.S. Pat. No. 5,301,444.

FIELD OF THE INVENTION

This invention relates generally to a display apparatus for animated marine life and is particularly related to a display device comprising a liquid vessel and one or more marine lives swimming freely therein to simulate an aquarium. More particularly, the present invention relates to such aquarium containing one or more magnetically activated toy fish swimming freely in an aquatic habitat must in the same way as a natural fish swims in the sea. In one aspect, this invention relates to an aquarium containing one or more, magnetically activated swimming toy fish and a plurality of magnetic members disposed in said aquarium, which coact with the toy fish.

BACKGROUND OF THE INVENTION

Magnetically activated animated objects are well known in the art. A magnetically activated toy fish in a display device is described, for example, in U.S. Pat. No. 3,239,956. This patent describes a marine life display apparatus in which an animated toy fish having a magnet therein is freely suspended in a liquid medium and is caused to move about therein in an effort to simulate the swimming movement of a natural fish. In the display device described in said patent, a power-driven magnetic means is disposed below the liquid medium in which the toy fish is freely suspended, and causes the fish to follow a continuous pattern of undulating movements through the liquid thus simulating the movements of a natural fish.

Japanese Patent Application Kokai No. 55-101,383 (1980) and Japanese Patent Application Kokai No. 60-168, 895 (1985) also disclose magnetically activated toy fish swimming in a liquid habitat.

Most of the heretofore known toy fish include a magnetic means and the fish is freely suspended in a liquid medium disposed in a vessel supported on a base or a panel, and a magnetic means is disposed below the supporting base. The magnetic means below the supporting base is rotated by a power source thereby varying the magnetic field generated by the magnet and thus activating the toy fish. However, the movements of the toy fish is limited, usually to vertical and horizontal movements, and fail to simulate the movements of natural fish, in all directions, in a discontinuous pattern.

A different type of aquarium is described in the aforementioned copending application Ser. No. 08/041,566, filed Apr. 2, 1993. The aquarium described therein comprises a housing and a transparent liquid vessel which is at least partially filled with a liquid, usually water, and in one embodiment, the liquid vessel has a convex front surface and a generally flat rear surface. A marine object such as a toy fish is freely suspended in the liquid, said toy fish having magnets therein and means for imparting buoyancy to the fish. One or more rotatable magnets disposed in said housing behind the rear surface of the liquid vessel rotate about a horizontal axis thus generating magnetic fields at different speeds. The magnetic toy fish and the rotating magnet or magnets co-act to cause the toy fish to move freely in all directions to simulate the swimming action of a natural fish in a liquid habitat.

A background plate depicting different scenes, such as a coral reef of a rock cave, can be disposed in the housing, behind the rear surface of said liquid vessel, to impart a more realistic and natural background scenery for the marine display.

In the marine display device described in said copending application, one toy fish is magnetically activated to swim about in the liquid. So far as it is known, there are no marine displays which contain, or which can accommodate a plurality of toy fish or marine lives, swimming in different directions, in one liquid-containing vessel.

Accordingly, it is an object of this invention to provide a marine display device containing a liquid medium and one or more marine toy objects, such as a fish, which are magnetically activated to swim freely in the liquid.

It is another object of this invention to provide a marine display device which is especially designed to contain and accommodate a plurality of magnetically activated toy fish or other similar marine lives, wherein the several toy fish are activated by means of differently positioned magnets in the marine display.

It is yet another object of this invention to provide a marine display device which simulates an aquarium of the type generally used for display and aesthetic purposes in homes, offices, restaurants and like places.

The foregoing and other features and objects of this invention will be more readily understood from the ensuing detailed description taken in conjunction with the accompanying drawings which depict the different embodiments of the invention, all of which form parts of this application.

SUMMARY OF THE INVENTION

A marine display device comprising a liquid vessel which may be in the general form of a liquid tank, a cup-shaped vessel or a prism. A plurality of toy marine objects, e.g., toy fish, are freely suspended in, and swim freely in the liquid. Each toy fish contains an air chamber for imparting buoyancy to the toy fish, and comprises a magnetic member which co-act with the magnetic field produced in the liquid thereby causing the fish to swim in all directions.

The display device of this invention also includes a plurality of magnetic field-creating devices such as magnetic plates, each plate being mounted on a rotatable shaft and being rotatable by said shaft. A means, such as a motor is connected to and causes rotation of the shafts, and the magnetic field-creating device, thus generating magnetic forces which act on the magnetic member in the toy fish and cause the toy fish to move about in omnidirectional manner within the liquid much as a natural fish swims in the sea. The magnetic field-creating devices are housed within chambers disposed within the liquid vessel in a manner which most efficiently produces magnetic forces through the liquid vessel.

Different embodiments are shown and described hereinafter in detail.

BRIEF DESCRIPTION OF THE DRAWINGS

In the drawings, wherein like reference numerals are used to designate like parts.

DETAILED DESCRIPTION OF THE INVENTION

Figure 1:
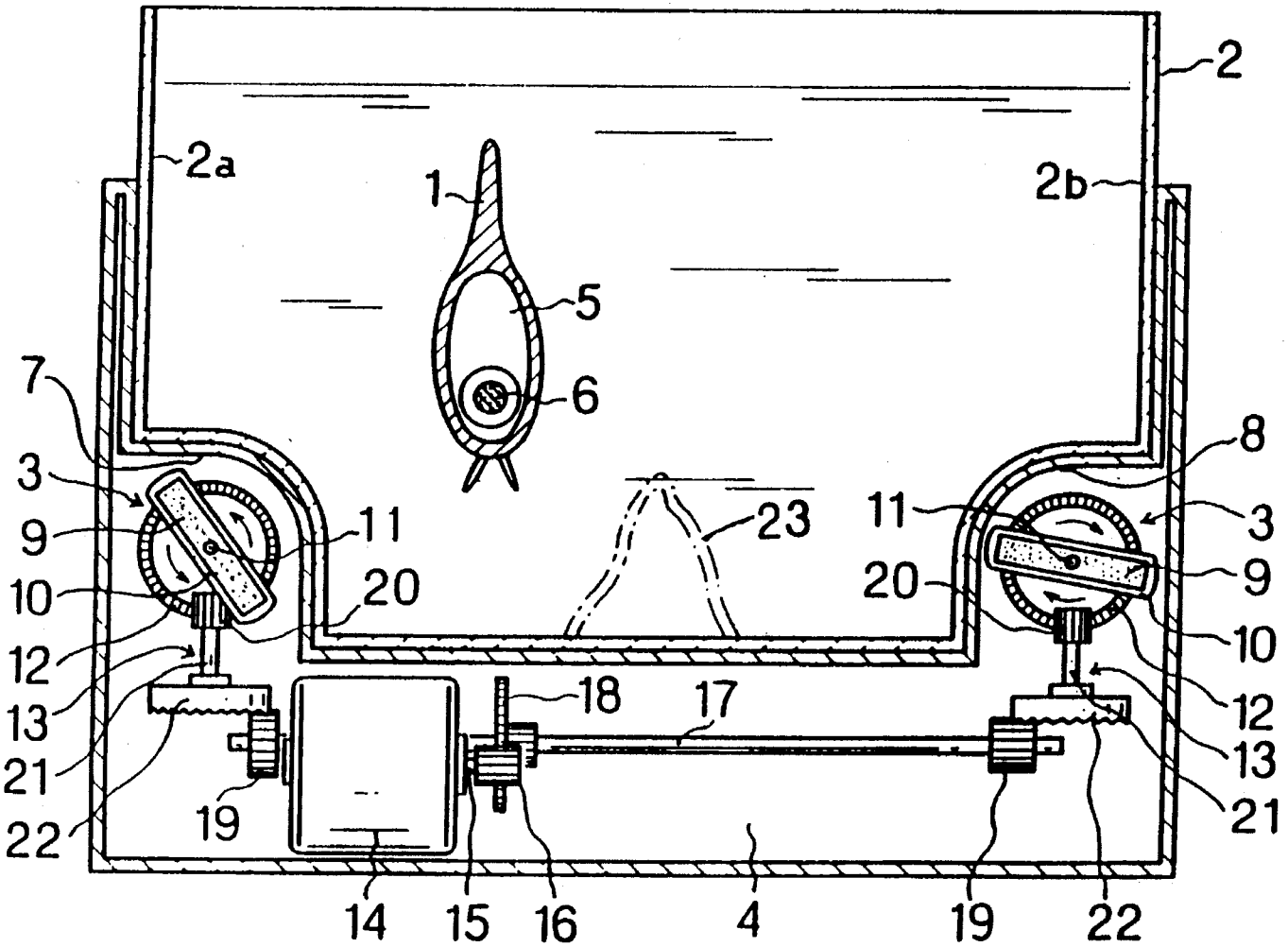
FIG. 1 is a longitudinal vertical section of an aquarium made according to one embodiment of the present invention.

Referring first to the embodiments of the invention shown in FIGS. 1–4, the marine display device comprises a water vessel or tank 2 containing a plurality of toy fish 1 swimming therein. The tank 2 has a base 4 and a magnetic field device 3. An air chamber 5 is provided in the fish 1 to impart buoyancy to the fish. Also disposed in the fish is a magnetic member 6 with its magnetic poles oriented in the longitudinal direction of the fish. The air chamber 5 may contain an air bag (not shown) in order to insure that the fish remain freely suspended in the liquid.

In FIG. 1, which shows one embodiment of this invention, the bottom halves of the left and right sidewalls 2*a*, 2*b* in water tank 2 are semi-spherically curved on the inside, thereby forming holding cavities 7,8 for housing the rotating magnetic field devices 3.

In the above-mentioned rotating magnetic field device 3, a magnetic plate 9 having north and south poles on its ends fits into and is supported by a supporting frame 10 which is formed of a non-magnetic material. Supporting shafts 11 provided at both ends of the support frame 10 are in turn supported by a machine housing (not shown).

Rotation of the magnetic plate 9 is carried out as follows: As shown in FIG. 1, a crown gear 12 is attached to the supporting shaft 11. The transmission mechanism 13 meshes with the gear 12 so that the rotation is transmitted from the rotating shaft 15 of the motor 14 to a pinion 16, and then to an intermediate shaft 17 via a large-diameter gear 18. Pinions 19, 19 attached at both ends of the intermediate shaft 17 each mesh with the crown gear 22 on a rotating shaft 21 attached to a pinion 20 at either end. In this way, rotation of the motor 14 is reduced and transmitted thus causing rotation of magnetic plates 9. The rotating magnetic field device 3 and the transmission mechanism 13 are situated on the base 4 of the tank.

When the holding cavities 7,8 in water tank 2 are large, part of the bottom portion of the tank may be allowed to project into the water tank as shown by the dashed lines so as to form a guiding and inducing portion 23.

A second embodiment of the invention will now be described with reference to FIG. 2. Here, the water tank 24 has simulated rock-shaped holding cavities 25,26 formed on the inside at the bottom half of left and right sidewalls 24*a*,24*b*. The rotating magnetic field devices 3 are housed in these holding cavities.

When the water tank 24 is made of a clear plastic material, these simulated rock-shaped holding cavities 25,26 can be formed by drawing simulated rock forms on a molded surface inside the water tank using paint, or by placing inside the tank a background member on which these simulated rocks have been drawn.

As in the first embodiment, in the rotating magnetic field device 3, a magnetic plate 9 having north and south poles on its ends fits into and is supported by a supporting frame 10 which is formed of a non-magnetic material. The supporting shafts 11 provided at both ends of the supporting frame 10 are in turn supported by a machine housing (not shown). These devices rotate the magnetic force generated from the magnetic plate 9 about the supporting shafts 11.

Rotation of each magnetic plate 9 is carried out as follows. As in the first embodiment, a crown gear 12 is attached to the supporting shaft 11 (FIG. 2). The transmission mechanism 13 that meshes with gear 12 is constructed so that the rotation is transmitted from the rotating shaft 15 of the motor 14 to a pinion 16, and then to an intermediate shaft 17 via a large-diameter gear 18. Pinions 19 attached at both ends of the intermediate shaft 17 mesh with a crown gear 22 on a rotating shaft 21 attached to a pinion 20 at either end. In this way, rotation of the motor 14 is reduced and transmitted thus causing rotation of magnetic plates 9.

In the second embodiment, a simulated rock-shaped guiding and inducing portion 27 is formed so as to project out into the water tank, as shown by the solid line, in one Dart of the bottom portion 24*c* between the simulated rock-shaped holding cavities 25,26. Below this, corresponding supporting shafts 11 are supported in a freely rotatable manner, and a large-diameter gear 28 attached to this meshes with a pinion 19 attached midway on the intermediate shaft 17, and a magnetic plate 9 is supported on a supporting frame 10 attached to the supporting shafts 11.

The holding cavities 7, 8, 25 and 26 are formed on the inside at the bottom half of left and right sidewalls 24*a* and 24*b*, but it is also possible to provide on the bottom surface 24*c* a holding cavity (not shown) that projects into the water tank in a box-like or conical shape, and to dispose a rotating magnetic field device 3 at the interior thereof.

In embodiments where the swimming toy 1 is in the form of a sinking fish, holding cavities 7, 8, 25 and 26 may also serve as guiding and inducing bodies that guide the swimming toys 1 at positions where the rising force of the rotating magnetic field devices 3 act.

Figure 2:
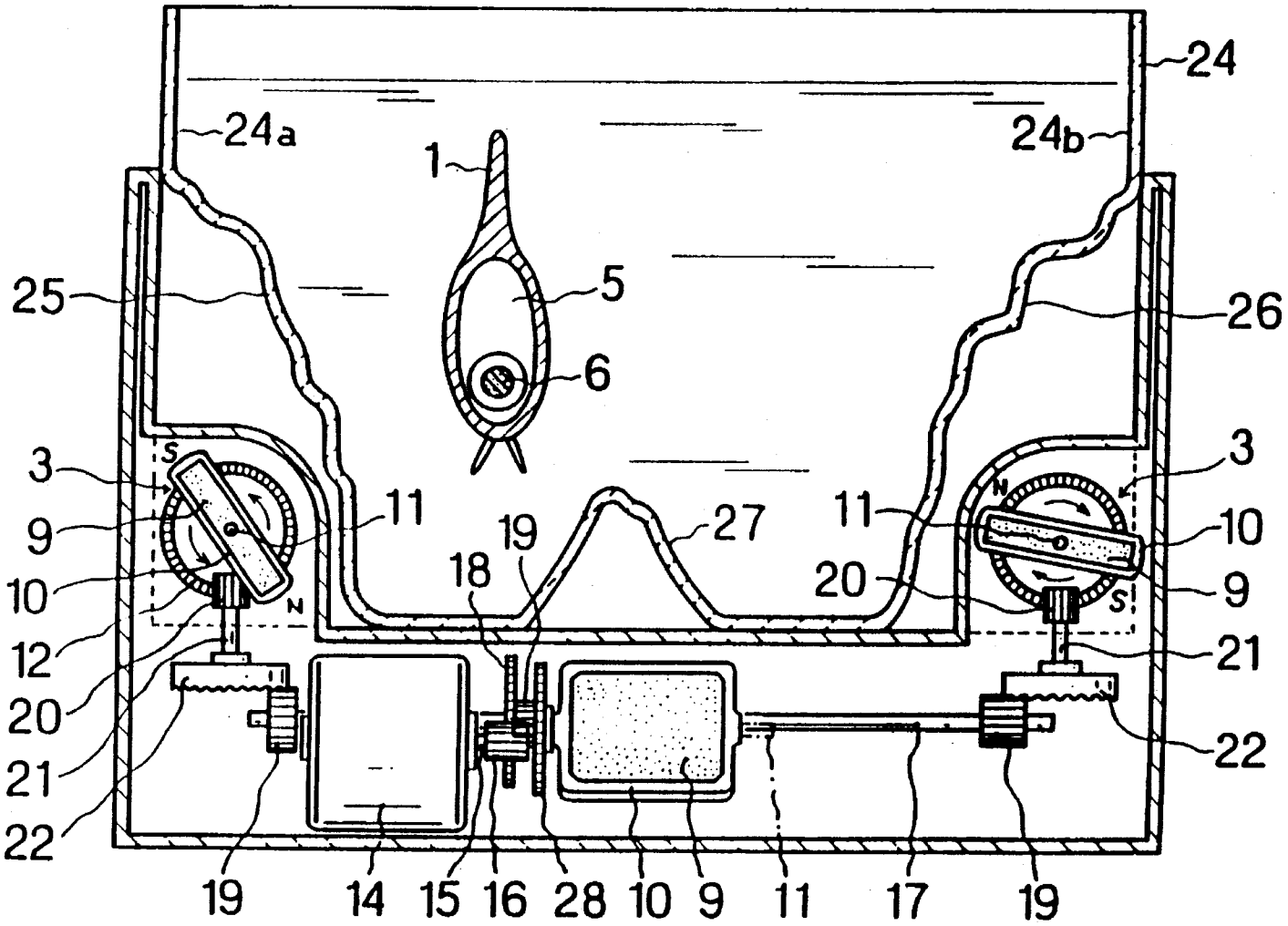
FIG. 2 is a longitudinal vertical section of an aquarium made according to another embodiment of the present invention.
Figure 3:
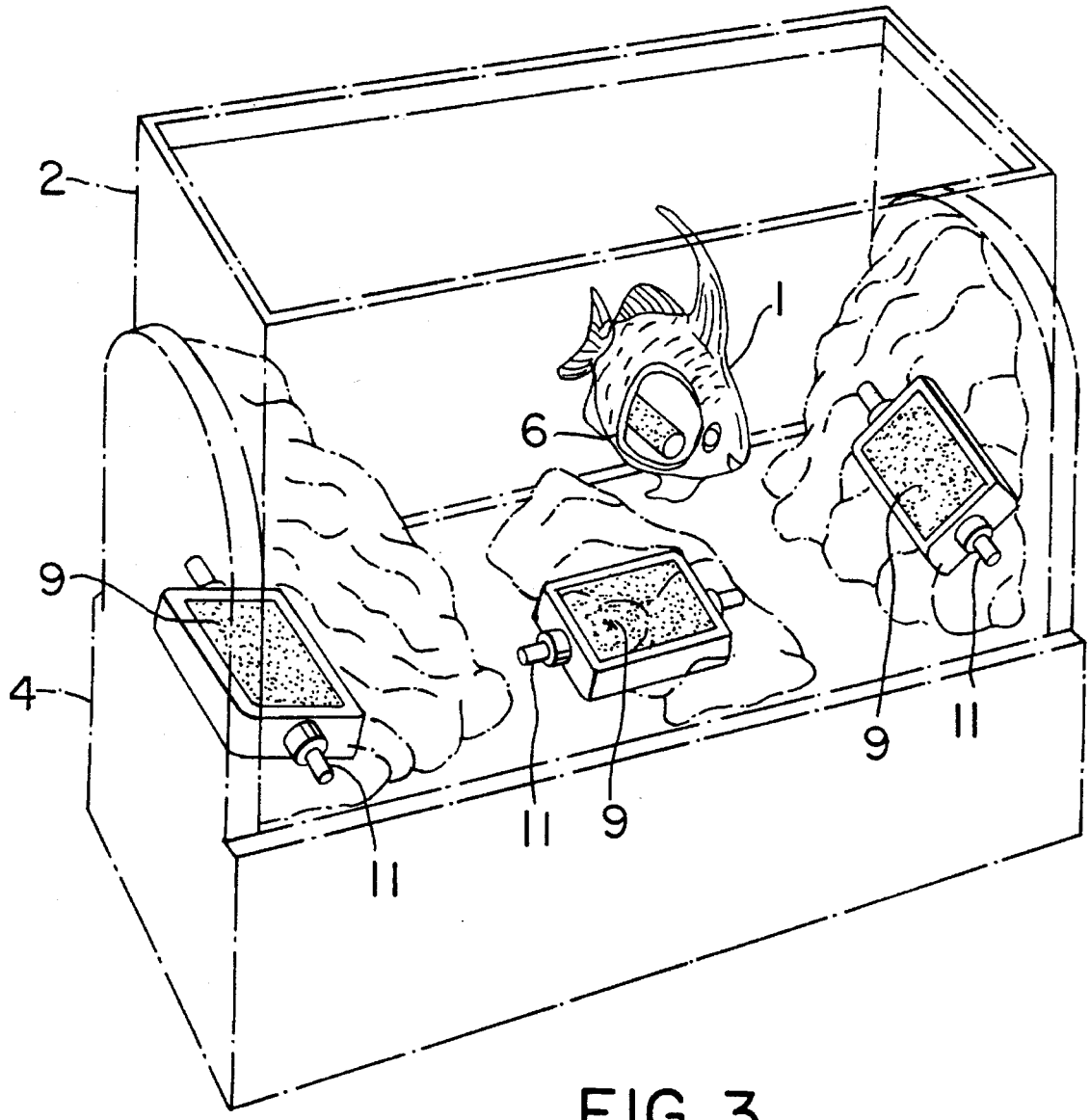
FIG. 3 is a perspective view of an aquarium according to the present invention.
Figure 4:
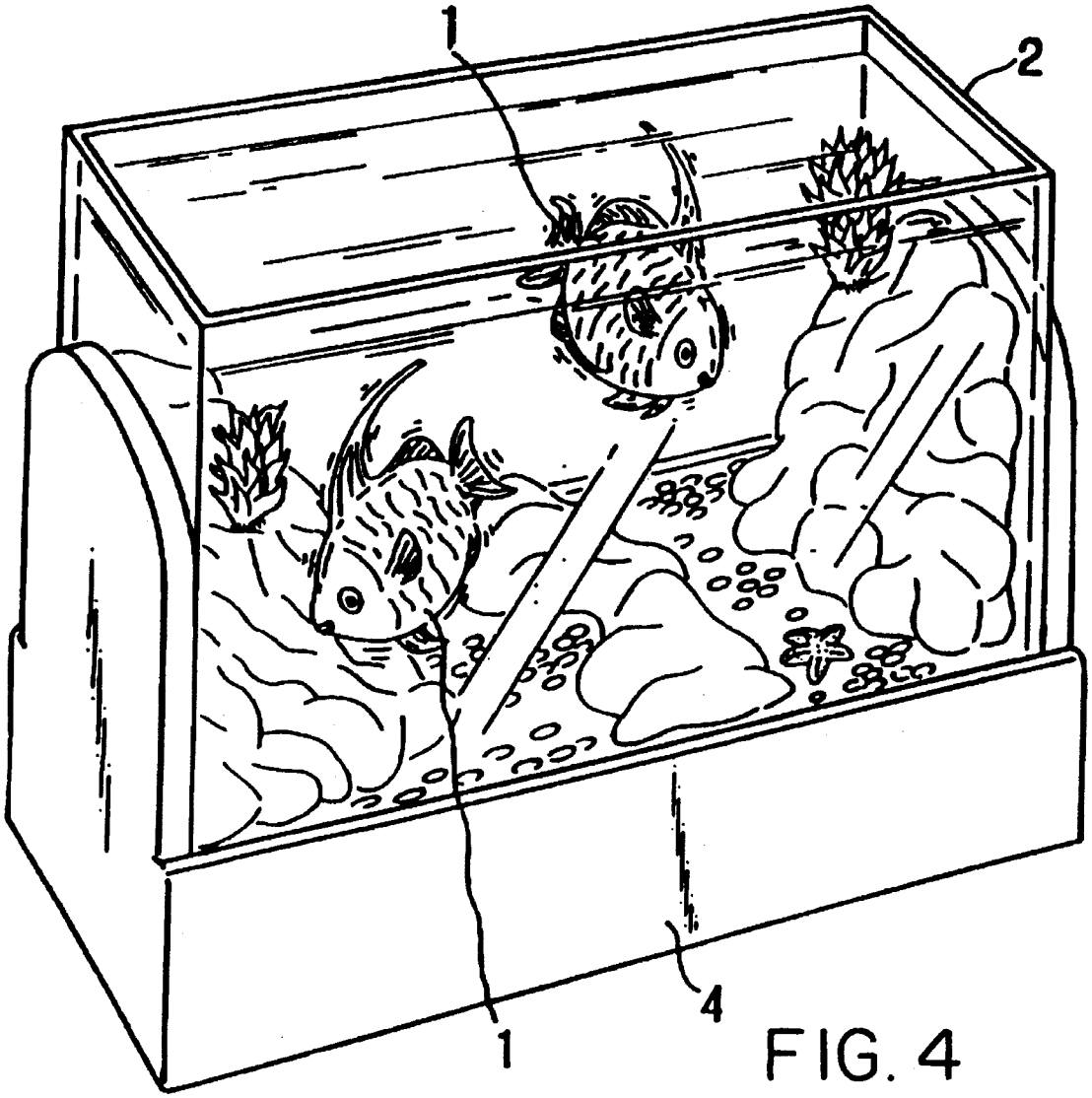
FIG. 4 is a perspective view similar to FIG. 3 and showing the axes of rotation of the magnetic plate members in the embodiment shown in FIG. 2.
Figure 5:
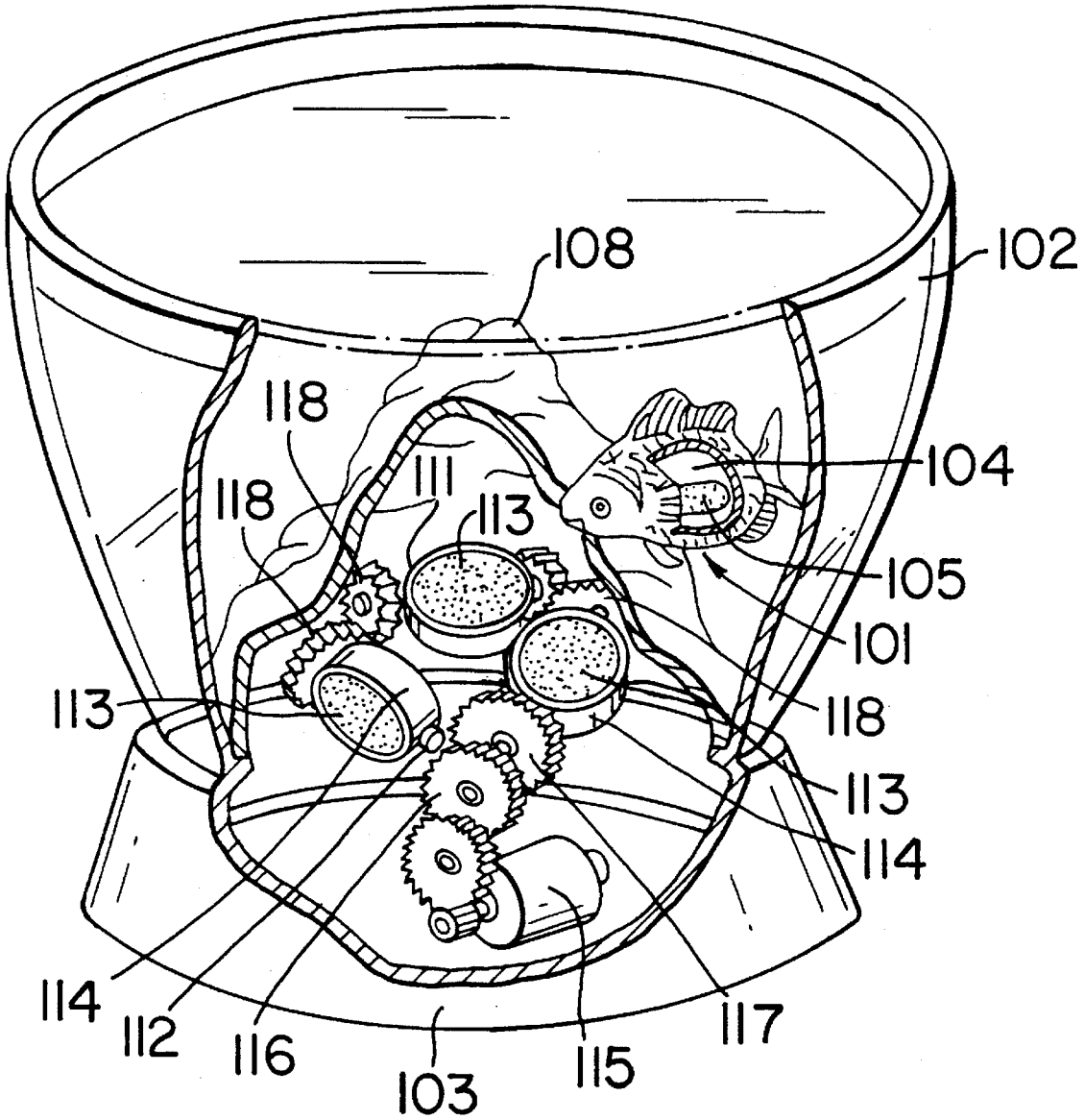
FIG. 5 is a partially cutaway perspective view of another embodiment of the present invention showing the omnidirectional upwardly-rotating magnetic field device.

In both the first and second embodiments shown in FIGS. 1 and 2, a horizontal axis of rotation is appropriate as the axis of rotation for the magnetic plate 9, but an inclined axis is also possible because it results in a rising force.

It can be seen from the description of FIGS. 1–4, that the embodiments described therein provide a plurality of holding cavities that project into the water tank 2 from the bottom half of the sidewalls, and disposed therein are the rotating magnetic field devices 3 that rotate about an axis of rotation which may be horizontal or somewhat inclined, and which is capable of imparting a rotating rising force to the fish. This construction causes the swimming toys that float or swimming toys that sink at a fixed speed to respond at a distance so as to swim into the rotating magnetic field, and also places a guiding and inducing body therebetween, which the swimming toys likewise swim and reach. Hence, the swimming toys are subjected primarily to an attractive rise or a repulsive rise due to the interaction between the magnet within the swimming toys and the rotating magnetic field. In this way the toy fish will swim freely much like a live fish, not only upward, horizontally, downward, and sideways from the left sidewall to the right sidewall, but also in forward and backward motions.

Reference will now be made to the embodiment of the invention illustrated in FIGS. 5 through 11. In the embodiment shown in FIG. 5, a toy fish 101 swims freely in a generally cup-shaped water vessel or tank 102 which is supported by the base 103. The swimming fish 101 contains a chamber 104 which may house an airbag (not shown) for imparting buoyancy to the fish. A magnetic member 105 is also housed within the toy fish 101, with its magnetic poles oriented in the longitudinal axial direction of the fish. In balance with buoyancy, swimming fish toys having a given sinking speed are the most compatible with the omnidirectional upwardly-rotating magnetic field device 106 having only an upward force as described below. However, the present invention is not limited to this made alone.

The water tank 102 is provided on its bottom surface with a conical holding projection 108 having a simulated rock form 107. A magnet chamber 109 is provided in the interior thereof.

In the omnidirectional upwardly-rotating magnetic field device 106 within the magnet chamber 109, rotating shafts 110,111 and 112 are supported in the form of a regular polygon (as an equilateral triangle in this embodiment) along a transverse plane A—A that transects the holding projection 108 in an essentially horizontal manner, and magnetic plates 113,113,113 are supported on the respective rotating shafts 110,111 and 112 via supporting frames 114, 114,114.

A transmission mechanism 116 reduces rotation from the motor 115 and transfers the rotation to a large-diameter gear 117 attached to rotating shaft 110. A bevel gear 118 is attached at one end of the rotating shaft 110, and transfers rotation to rotating shaft 11 having attached at the corresponding end thereof another bevel gear 118 that meshes with the first bevel gear 118. In addition, rotation is also transferred to a rotating shaft 112 having attached at the corresponding end thereof another bevel gear 118 that meshes with the first bevel gear 118. If the number of teeth on each gear 118 is the same, the gears will all have the same rotation.

Figure 8:
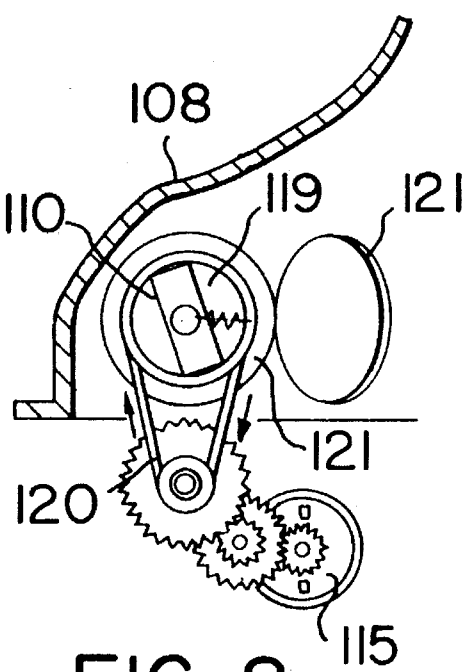
FIG. 8 is a partial front view showing a different embodiment of the transfer mechanism in the omnidirectional upwardly-rotating magnetic field device.
Figure 7:
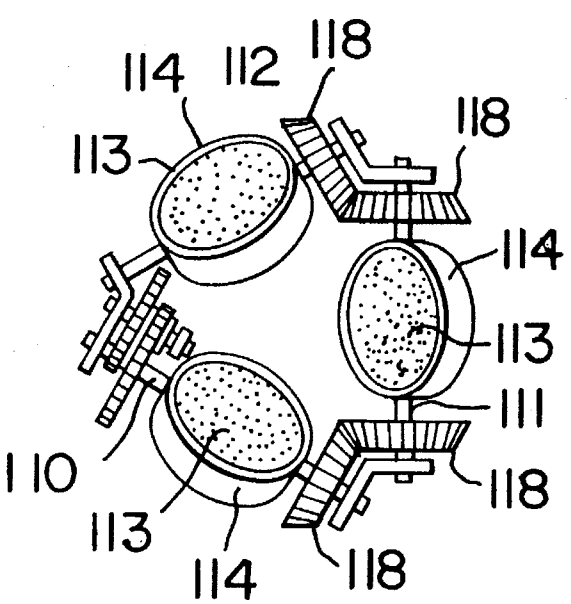
FIG. 7 is a partial top view showing the transfer mechanism of the omnidirectional upwardly-rotating magnetic field device.
Figure 6:
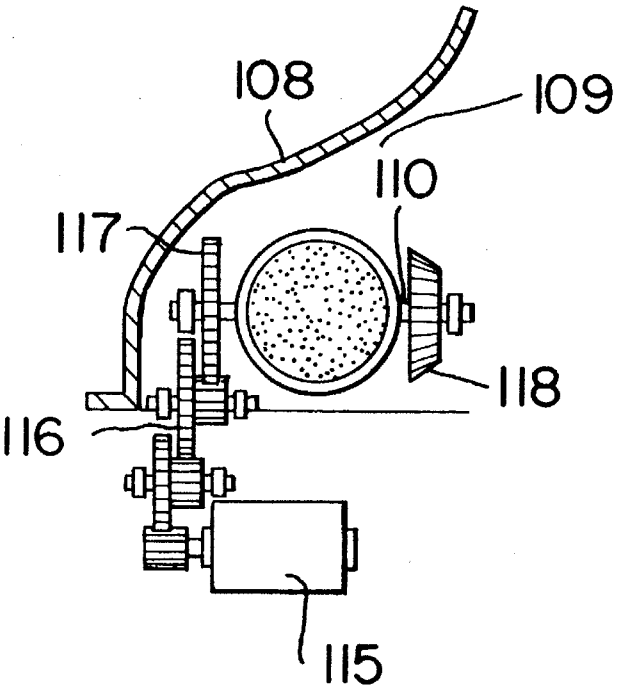
FIG. 6 is a partial front view showing the transfer mechanism of the omnidirectional upwardly-rotating magnetic field device.

In FIGS. 6–8, there are shown a transmission system for rotating shafts 110, 111 and 112 that supports the magnetic plates 113. A pulley 119 is attached to rotating shaft 110, and rotation from the motor 115 is transferred by a belt 120 to rotating shafts 111 and 112 by means of transfer wheels 121,121,121 that revolve about the periphery of supporting frames 114,114,114 for the respective rotating shafts 110,111 and 112, which are attached so as to be connected at the center of a regular polygonal shape in which each of the rotating shafts 110,111 and 112 is disposed. Also shown are the traction springs 122,122,122 which bias the magnetic plates 113 and hold them in position.

Figure 11:
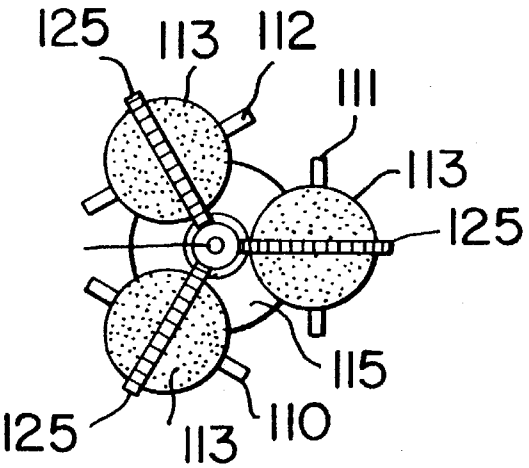
FIG. 11 is a partial top view showing the third embodiment of the transfer mechanism in the omnidirectional upwardly-rotating magnetic field device.
Figure 10:
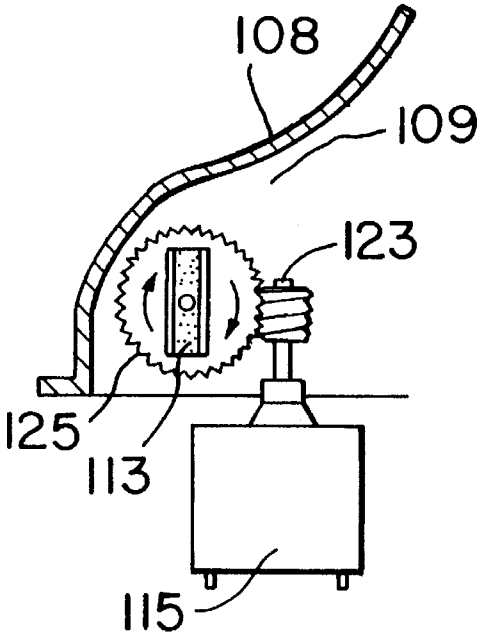
FIG. 10 is a partial front view showing a third embodiment of the transfer mechanism in the omnidirectional upwardly-rotating magnetic field device.
Figure 9:
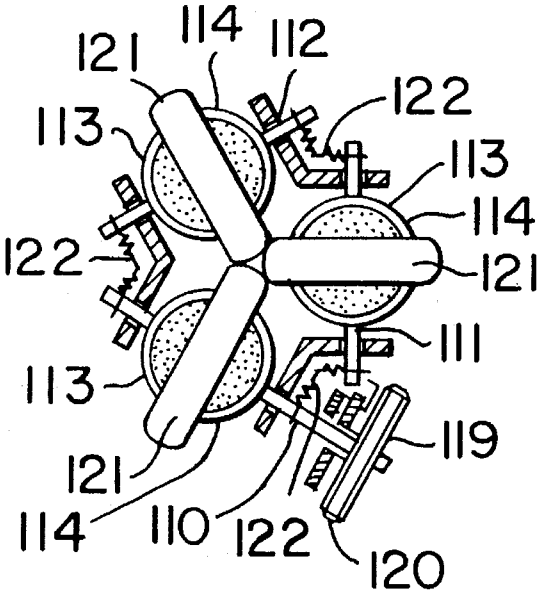
FIG. 9 is a partial top view showing another embodiment of the transfer mechanism in the omnidirectional upwardly-rotating magnetic field device.

FIGS. 9–11 show another embodiment of a transmission system for rotating shafts 110,111 and 112 that support magnetic plates 113. Gears 125,125,125 which revolve on the periphery of the supporting frames 114,114,114 for the respective rotating shafts 110,111 and 112 are engaged directly with a worm gear 124 attached to the rotating shaft 123 of the motor 115.

The embodiment shown in FIGS. 5–11 permit the swimming toys within the water tank to swim in a free, varied, and natural manner due to the upwardly-rotating forces of the magnetic forces generated by the omnidirectional upwardly-rotating magnetic field device.

Figure 12:
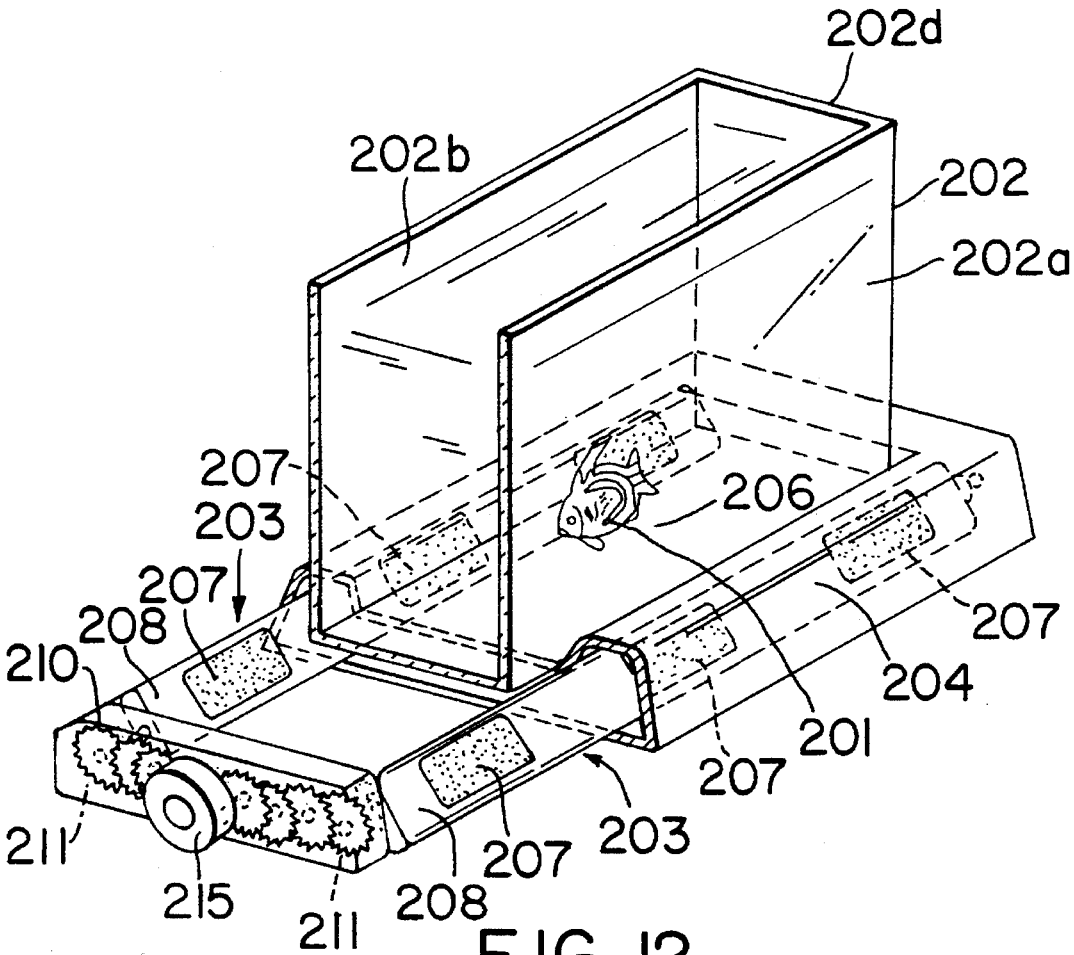
FIG. 12 is a longitudinal vertical section showing another embodiment of a marine display device embodying the principles of this invention.
Figure 13:
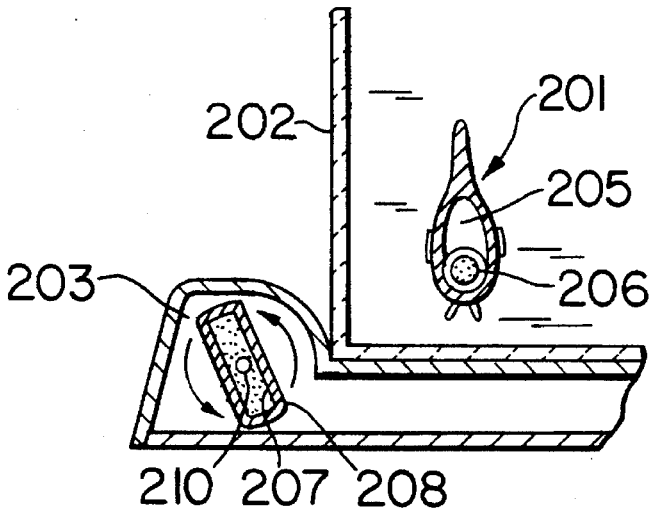
FIG. 13 is a partial cutaway cross-sectional view showing the interaction between the toy fish in the liquid vessel with the rotating magnetic member.

Referring now to FIGS. 12 through 16, yet another embodiment of the invention will be described. As shown in FIG. 12, the swimming toy fish 201 swims freely in a liquid within the water tank 202 which is supported on a base 204. A pair of magnetic field devices 203 are disposed within the base 204 in the manner shown in this figure.

As in the other embodiment of this invention, the swimming toy fish 201 contains air chamber 205 and further comprises a magnetic member 206 which has a vertical action. The magnet within each fish is disposed so that both magnetic poles are oriented in the lengthwise direction. In balance with buoyancy, swimming toys having a given sinking speed are the most compatible with the rotating magnetic field device 203 which exert only an upward force. However, the invention is not limited to this arrangement.

Water tank 202 is in the form of rectangular prism consisting of front and back sidewalls 222*a*,222*b* left and right sidewalls 222*c*,222*d* and a bottom panel 222*e*. The bottom of this water tank fits into a recessed mounting member 204*a* formed on the top surface of a base 204.

The above-mentioned rotating magnetic field device 203 is designed so that magnetic plates 207 having north and south poles on the ends thereof are supported at given intervals on supporting frames 208 formed of a non-magnetic material, supporting shafts 209 provided on both end of these supporting frames 208 which are in turn supported on a machine frame 210, and the magnetic forces generated from the magnetic plates 207 about the axes of the supporting shafts 209 rotate upward toward the water tank 202.

As sown in FIGS. 12–16, rotation of the magnetic plates 7 is achieved by a multiple-stage arrangement in which large-diameter gears 211 are attached to the supporting shafts 209, and the pinions 212 and large-diameter gears 213 that mesh with this successively mesh with a pair of intermediate gears 214. The last large-diameter gears 213 mesh with a pinion 217 on the rotating shaft 216 of the motor 215. In this way, the rotation of the motor 215 is reduced and transmitted to the supporting shafts 219. The magnetic forces of the mutually corresponding magnetic plates 217 rotate upward with respect to the water tank 202.

Simulated rocks 218, water plants 219 and pebbles 220 are scattered about the interior of the water tank 202 (see FIG. 16) in order to impart a more aesthetic appearance to the aquarium.

These simulated rocks 18 and pebbles 20 may be "protrusion-molded" by a vacuum pack process, and then colored, although they may be made in other suitable manner.

In the embodiment described in FIGS. 12–16, the magnetic plates are supported on rotating shafts which are, in turn, supported along the width on the outside of a water tank. The magnetic forces generated from the magnetic plates by rotation about the axes of the rotating shafts rotate upward within the water tank, as a result of which the upward rotating forces exerted by the magnetic forces generated by the magnetic plates cause the swimming toys to swim within the water tank. Hence, the interactions between the magnets built into the swimming toys and the rotating magnetic fields produce highly varied swimming motions.

In cases where there is a plurality of two or more swimming toys within the water tank, when exposed to the powerful rotating magnetic forces exerted by the magnetic plates, these are attracted or repelled, thereby dispelling the mutual attraction and causing the toys to swim independently, with the effect of providing a variety of swimming action.

In particular, because a plurality of magnetic plates is supported at given intervals on supporting frames, and the rotating fields about the supporting shafts are arranged along the width of the wide tank, not only does this dispel the mutual attraction of the fish mentioned earlier, but it also allows the fish to swim freely in the width direction.

Other modifications of the different embodiments are obvious from the foregoing descriptions and fall within the scope of this invention.

For example, while the embodiment in FIG. 12 shows the rotating magnets 207 are mounted on tracks which are slideable within the base 204, such construction is not necessary, and it may be more convenient to mount the rotating magnets on rotatable shafts located underneath the base 204.

Figure 14:
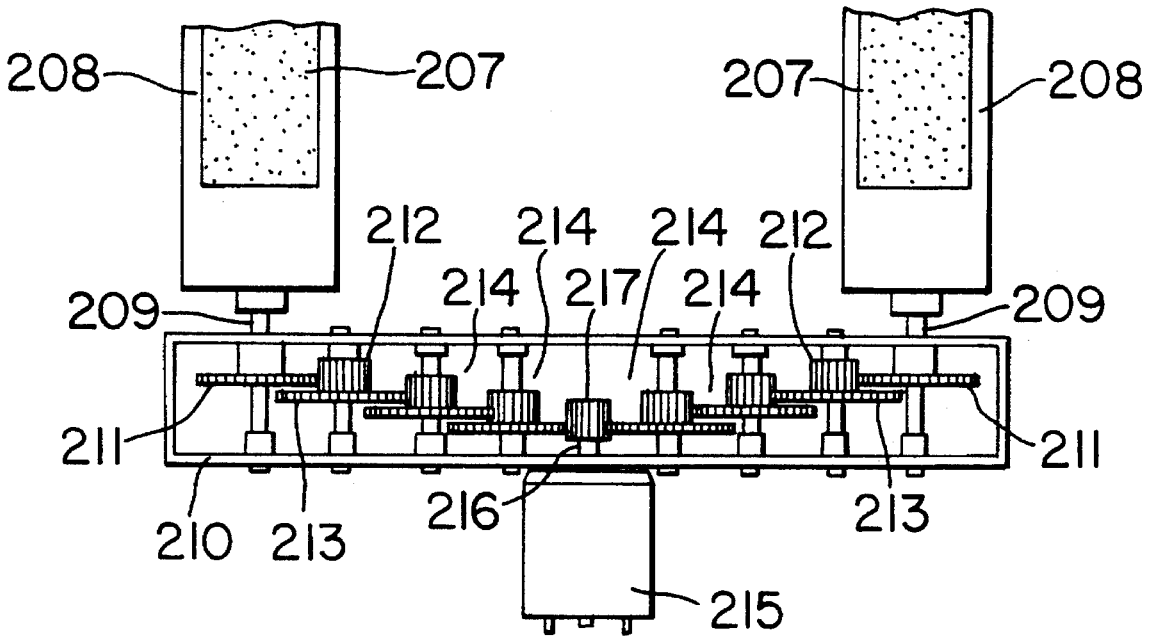
FIG. 14 is a cross-sectional top view showing the transmission mechanism between the motor and the supporting shafts.
Figure 15:
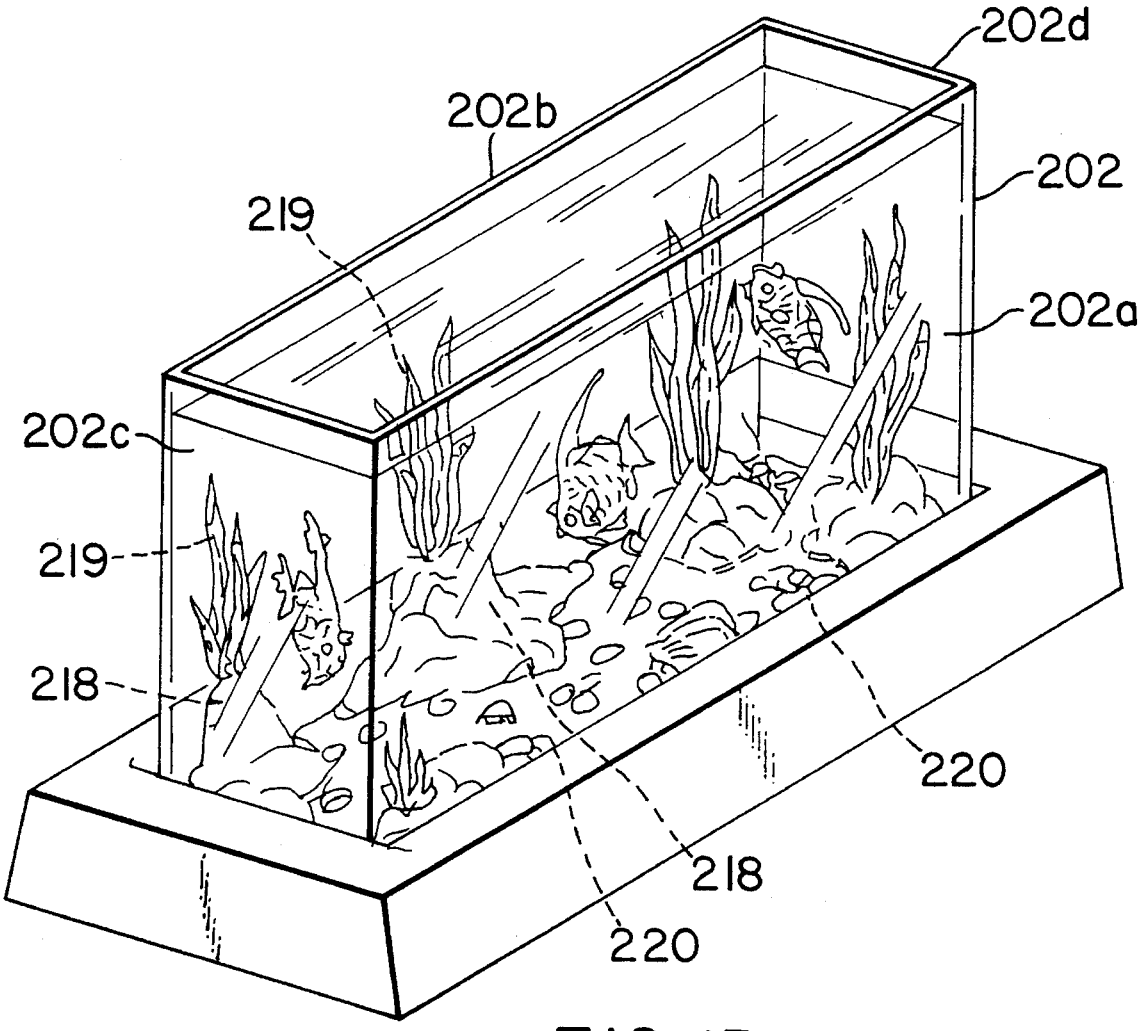
FIG. 15 is a perspective view of an aquarium made in accordance with yet another embodiment of the present invention.

Also, in the embodiment shown in FIG. 14, the rotating magnets 207 rotate in the same direction. However, if desired, these magnets may be made to rotate in opposite directions from one another by the addition of one more step down gears. These and other modifications are obvious to one skilled in the art.

I claim:

1. A marine display device comprising a liquid vessel having opposed sidewalls, a bottom closure base and an open top, said vessel containing at least one toy fish, said toy fish having an air chamber for imparting buoyancy to the toy fish, and comprising a magnetic member, a pair of spaced apart chambers projecting upward from the base of the vessel, a rotatable magnetic field-creating member in each of said chambers, a pair of rotatable shafts each connected to one rotatable magnetic field-creating member in each of said chambers, and means for simultaneously rotating each of said rotatable shafts.

2. A marine display device as in claim 1 wherein each rotatable magnetic field-creating member is a magnetic plate.

3. A marine display device as in claim 1 wherein said means for rotating each of said rotatable shafts is a motor.

4. A marine display device as in claim 2 wherein said means for rotating each of said rotatable shafts is a motor.

5. A marine display device comprising a container in the general form of a cup having liquid therein, said cup having peripheral walls, a bottom closure base and an open top, said cup containing at least one toy fish in said liquid, said toy fish having an air chamber for imparting buoyancy to the toy fish, a magnetic member in said toy fish, a plurality of holding cavities which project from the lower half of the peripheral walls into the cup, a rotatable magnetic field-creating member in each of said holding cavities, a pair of rotatable shafts each connected to one rotatable magnetic field-creating member in each of said holding cavities, and means for simultaneously rotating each of said rotatable shafts.

6. A marine display device as in claim 5 wherein each rotatable magnetic field-creating member is a magnetic plate.

7. A marine display device as in claim 5 wherein said means for rotating each of said rotatable shafts is a motor.

8. A marine display device as in claim 6 wherein said means for rotating each of said rotatable shafts is a motor.

9. A marine display device as in claim 5, and further including a guiding and inducting member projecting from the base of the display device into the cup.

10. A marine display device as in claim 6, and further including a guiding and inducting member projecting from the base of the display device into the cup.

11. A marine display device as in claim 7, and further including a guiding and inducting member projecting from the base of the display device into the cup.

12. A marine display device as in claim 8, and further including a guiding and inducting member projecting from the base of the display device into the cup.

13. A marine display device as in claim 2, 4, 6 or 8 wherein each magnetic plate is disposed at an angle relative to the other magnetic plate.

14. A marine display device comprising a liquid vessel having opposed sidewalls, a bottom wall and an open top, a base having a pair of chambers extending upwardly from said base, each chamber being disposed at one side of said base, said vessel containing at least one toy fish, said toy fish having an air chamber for imparting buoyancy to the fish, and comprising a magnetic member, a rotatable magnetic field-creating member in each of said chambers of said base, a pair of rotatable shafts each operatively connected to one magnetic field-creating member in each of said chambers, and means for rotating each of said rotatable shafts simultaneously.

15. A marine display device as in claim 14 wherein each said rotatable magnetic field-creating member is a magnetic plate.

16. A marine display device as in claim 14 wherein said means for rotating each of said rotatable shaft is a motor.

17. A marine display device as in claim 15 wherein said means for rotating each of said rotatable shaft is a motor.

18. A marine display device as in claim 14 wherein said liquid vessel is in the general shape of a prism having a front wall, back wall, opposed side walls and a bottom panel, said base having a recessed top surface for mounting said vessel on said base.

19. A marine display device as in claim 15 wherein said liquid vessel is in the general shape of a prism having a front wall, back wall, opposed side walls and a bottom panel, said base having a recessed top surface for mounting said vessel on said base.

20. A marine display device as in claim 16 wherein said liquid vessel is in the general shape of a prism having a front wall, back wall, opposed side walls and a bottom panel, said base having a recessed top surface for mounting said vessel on said base.

21. A marine display device as in claim 17 wherein said liquid vessel is in the general shape of a prism having a front wall, back wall, opposed side walls and a bottom panel, said base having a recessed top surface for mounting said vessel on said base.

* * * * *